US011426017B2

(12) United States Patent
Chan

(10) Patent No.: US 11,426,017 B2
(45) Date of Patent: Aug. 30, 2022

(54) DUAL-MODE CUP LID AND DRINKING CUP

(71) Applicant: I-on-Technology Limited, Kowloon (HK)

(72) Inventor: Chi Kuen Chan, Kowloon (HK)

(73) Assignee: I-ON-TECHNOLOGY LIMITED, Hong Kong (CN)

( * ) Notice: Subject to any disclaimer, the term of this patent is extended or adjusted under 35 U.S.C. 154(b) by 18 days.

(21) Appl. No.: 16/906,847

(22) Filed: Jun. 19, 2020

(65) Prior Publication Data

US 2020/0397167 A1 Dec. 24, 2020

(30) Foreign Application Priority Data

Jun. 21, 2019 (CN) ..... 201920946809.1

(51) Int. Cl.
*A47G 19/22* (2006.01)
*B65D 47/12* (2006.01)
*B65D 47/24* (2006.01)

(52) U.S. Cl.
CPC ..... *A47G 19/2272* (2013.01); *B65D 47/122* (2013.01); *B65D 47/248* (2013.01); *B65D 2543/00046* (2013.01)

(58) Field of Classification Search
CPC .. B65D 51/1683; B65D 47/248; B65D 47/04; A47G 17/2272; Y10T 29/49826; Y10T 29/79883; Y10T 29/79895
USPC ..... 220/203.01, 0.05, 0.17, 0.23
See application file for complete search history.

(56) References Cited

U.S. PATENT DOCUMENTS 5,957,317 A * 9/1999 Lee ..... B65D 81/2038 220/212
10,512,347 B1 * 12/2019 Shepard ..... B65D 47/148
2018/0265266 A1 * 9/2018 McNamara ..... A47G 19/2272
2019/0283939 A1 * 9/2019 George ..... B65D 39/0052

FOREIGN PATENT DOCUMENTS

CN 106364805 A * 2/2017
JP 3215935 U * 4/2018 ..... A47G 19/2205
WO WO-2019154495 A1 * 8/2019 ..... B65D 47/248

* cited by examiner

*Primary Examiner* — Valentin Neacsu
*Assistant Examiner* — John Martin Hoppmann
(74) *Attorney, Agent, or Firm* — Muncy, Geissler, Olds & Lowe, P.C.

(57) ABSTRACT

The utility model disclosed a dual-mode cup lid, wherein comprising a lid main body, a spout is on said lid main body, a push button mechanism used for opening or closing said spout, a direct drinking mouth is set on said lid main body, an elastic switching mechanism used for opening or closing said direct drinking mouth also set on said lid main body. In comparison with the prior art, the utility model enriches the use method of cup lid, and can meet diversified needs of users for drinking beverages with different temperatures.

8 Claims, 14 Drawing Sheets

DUAL-MODE CUP LID AND DRINKING CUP

TECHNICAL FIELD

The utility model relates to the field of daily necessities, in particular to a dual-mode cup lid and drinking cup.

BACKGROUND OF THE UTILITY MODEL

At present, regular shops sell beverages, such as coffee, bubble tea, milk tea, coke, etc., to consumer together with paper cups or plastic cups. Consumers discard these paper cups or plastic cups after drinking all the drinks, which not only causes environmental pollution, but also wastes a lot of valuable earth resources and energies to make innumerable paper cups or plastic cups. Today, the global pollution and carbon dioxide emissions are extremely serious. The consumption behavior of paper cups or plastic cups is still a huge killer of global pollution and warming.

Nowadays, some drinks shops recommend to bring own drinking cups for consumption in the market. The existing vacuum cups or portable cups are generally designed for hot drinks with direct drinking mouth. However, cold drinks are also indispensable in hot summer season, but it is not a good choice to have cold drinks through direct drinking mouth, especially when drinking smoothies, it may make the drinkers feel uncomfortable if their lips or teeth touch the cold smoothies, therefore a straw is necessary to have cold drinks.

Existing drinking cups have below disadvantages:

1. Existing vacuum cups or portable cups only provide direct drinking mouth for hot or warm drinks, which is not convenient for cold drinks;
2. Existing cups for cold drinks are used with extra straws to avoid ice touching the lips and making the drinkers feel uncomfortable;
3. For the cups with built-in straw in the market, if put in hot drinks and close the lid, due to the temperature difference and air pressure issues, the hot drinks may easily spray out from the straw when opening the lid, thus cause danger.
4. It is easy to burn the mouth if have hot drinks with a straw.

Summary of the Utility Model

The utility model provided a dual-mode cup lid and drinking cup, which aims to enrich the use method of cup lid, can meet diversified needs of users for drinking beverages with different temperatures.

In order to achieve above purpose, the utility model provided a dual-mode cup lid, wherein comprising a lid main body, a spout is on said lid main body, a push button mechanism used for opening or closing said spout, a direct drinking mouth is set on said lid main body, an elastic switching mechanism used for opening or closing said direct drinking mouth also set on said lid main body.

Further technical scheme of the utility model is that, said elastic switching mechanism comprises a bounce buckle, a horseshoe-shaped pressure seat and a water outlet silicone on said horseshoe-shaped pressure seat provided opposite to said direct drinking mouth; said bounce buckle is fixedly connected to said horseshoe-shaped pressure seat, when pushing said horseshoe-shaped pressure seat, said bounce buckle will drive said horseshoe-shaped pressure seat to move up and down through elasticity, thereby controlling the said water outlet silicone to leave or seal the said direct drinking mouth, in order to realize opening or closing of said direct drinking mouth.

Further technical scheme of the utility model is that, said bounce buckle comprises a buckle rod, a buckle shell, a hook and a buckle ring, said buckle rod is installed in said buckle shell, said buckle ring is installed at the bottom of said buckle shell, sliding slot is set in said buckle rod, said sliding slot has open position and close position, one end of said hook is on the said open position or close position, another end of said hook connects to said buckle ring, the upper end of said buckle shell connects to said horseshoe-shaped pressure seat.

Further technical scheme of the utility model is that, said horseshoe-shaped pressure seat comprises a horseshoe-shaped pressure seat entity, at least three guide shafts installed on said horseshoe-shaped pressure seat entity, springs are installed on said guide shafts, the lower ends of said springs connect with lid main body, said water outlet silicone is installed at the bottom of said horseshoe-shaped pressure seat entity, said horseshoe-shaped pressure seat entity connects to said buckle shell.

Further technical scheme of the utility model is that, said push button mechanism comprises button, push part, torsional spring, the first cover and the second cover; said button is on said lid main body, said button connects to clip of said push part, said first and second cover are respectively on two sides of said spout, said push part is set on said first and second cover through said torsional spring; when said button is pushed by external force, said push part will push said spout to bounce under elasticity of said torsional spring.

Further technical scheme of the utility model is that, there is a pressure ring setting on the middle-upper part of said spout.

Further technical scheme of the utility model is that, said lid main body is set on external cup, cup lid silicone is set at the bottom of said lid main body, said horseshoe-shaped pressure seat entity has pressure plate, allochroic silicone and metal thermal conductor that connects to said allochroic silicone, said allochroic silicone is set between said pressure plate and said horseshoe-shaped pressure seat entity, said metal thermal conductor extends to inside said cup, in order to transfer the temperature inside said cup to said allochroic silicone; said metal thermal conductor has sealing ring and sealing plug.

Further technical scheme of the utility model is that, a straw is set under said spout, said straw extends to the bottom of said cup.

Further technical scheme of the utility model is that, there are a suck air inlet and a direct drinking air inlet on said lid main body, the suck sealing silicone which matches to said suck air inlet is set at the bottom of said lid main body, the direct drinking sealing silicone which matches to said direct drinking air inlet is set on said horseshoe-shaped pressure seat.

Besides, the utility model also provided a drinking cup, comprising said dual-mode cup lid of claims 1-8.

Advantageous result of the utility model: Through above technical schemes, the dual-mode cup lid and drinking cup of the utility model comprise a lid main body, a spout is on said lid main body, a push button mechanism used for opening or closing said spout, a direct drinking mouth is set on said lid main body, an elastic switching mechanism used for opening or closing said direct drinking mouth also set on said lid main body. It enriches the use method of cup lid, can meet diversified needs of users for drinking beverages with different temperatures.

Figure 1:
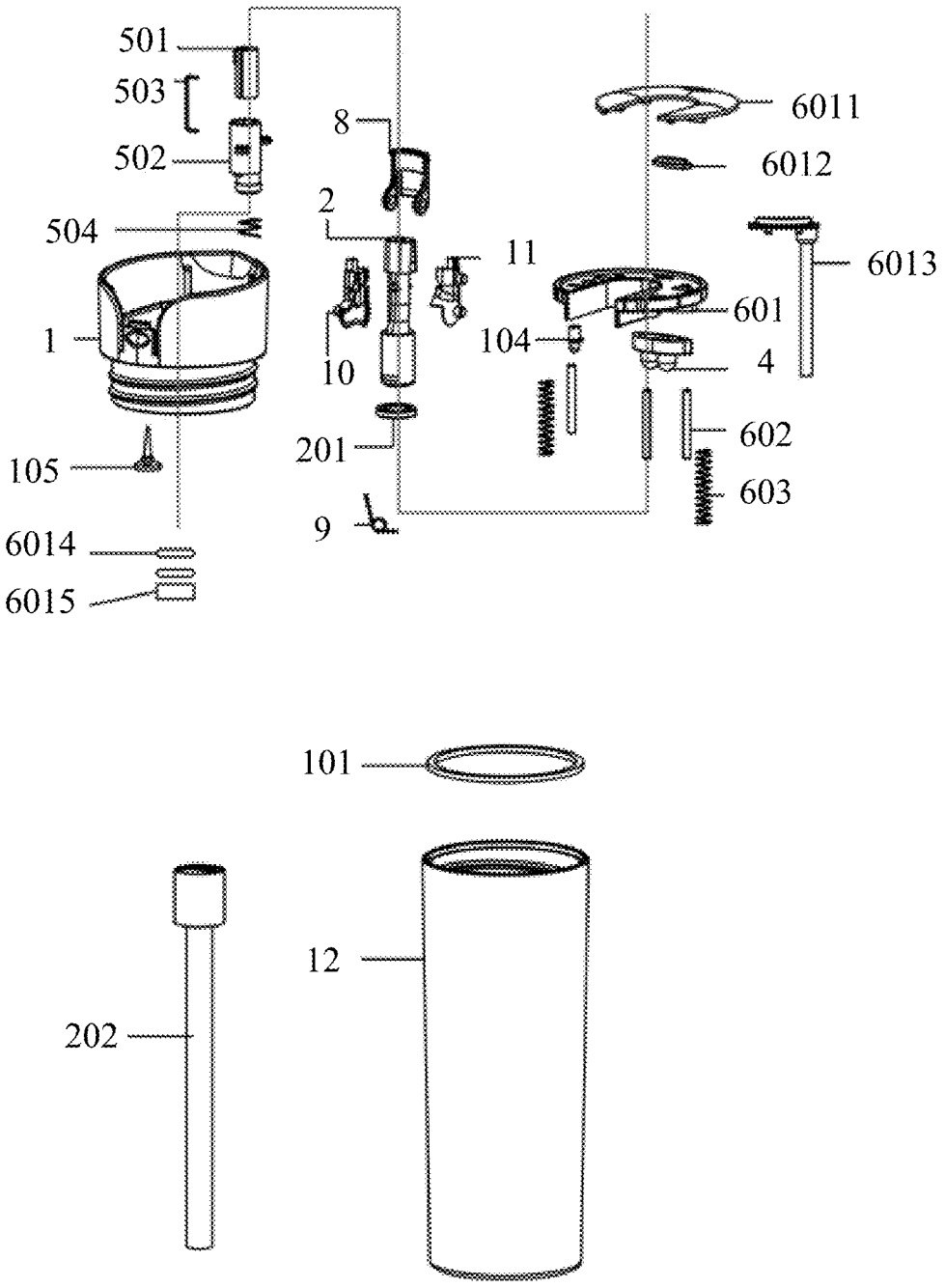
FIG. 1 is the exploded structure diagram of preferred embodiment of dual-mode cup lid of the utility model.

The implementation, function and advantage of the utility model will be further described combining with embodiment and referring to the drawings.

DETAILED EMBODIMENT OF THE UTILITY MODEL

It should be understood that, the embodiment described herein are only used for explaining the utility model, but not to limit the utility model.

Figure 2:
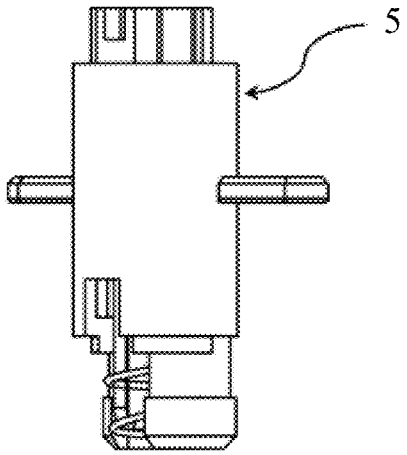
FIG. 2 is the overall structure diagram of bounce buckle in preferred embodiment of dual-mode cup lid of the utility model.
Figure 3:
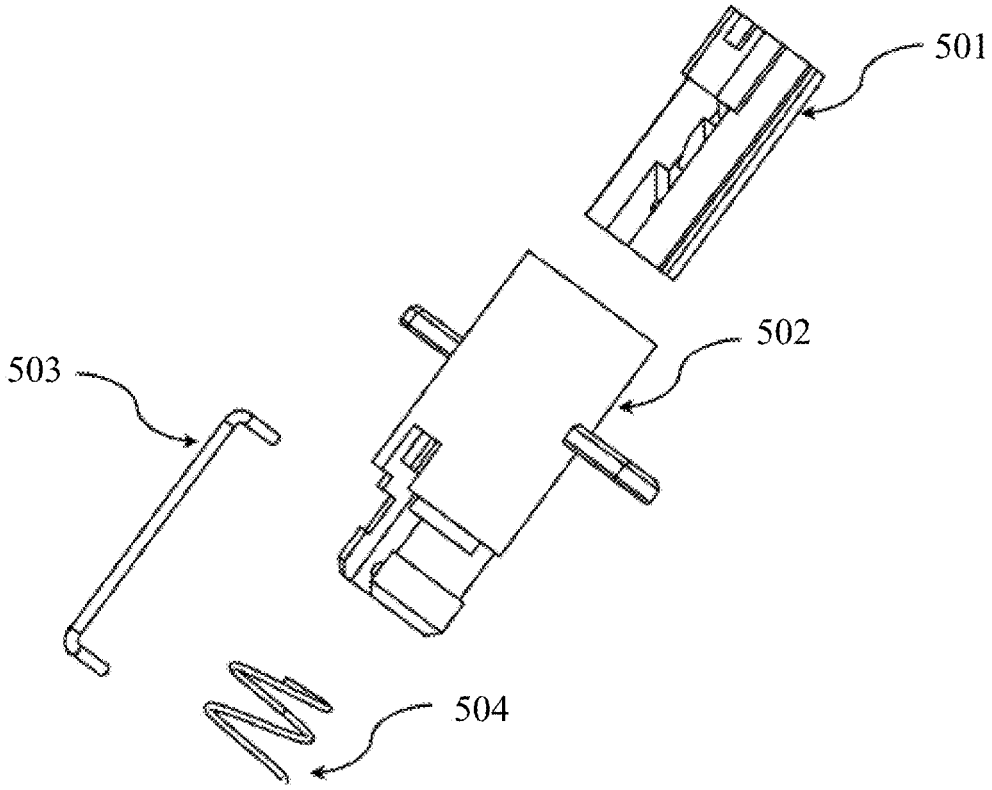
FIG. 3 is the exploded structure diagram of bounce buckle in preferred embodiment of dual-mode cup lid of the utility model.
Figure 4:
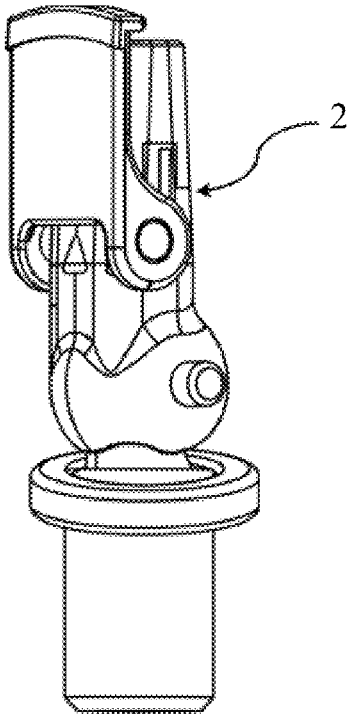
FIG. 4 is the overall structure diagram of push button mechanism in preferred embodiment of dual-mode cup lid of the utility model.
Figure 5:
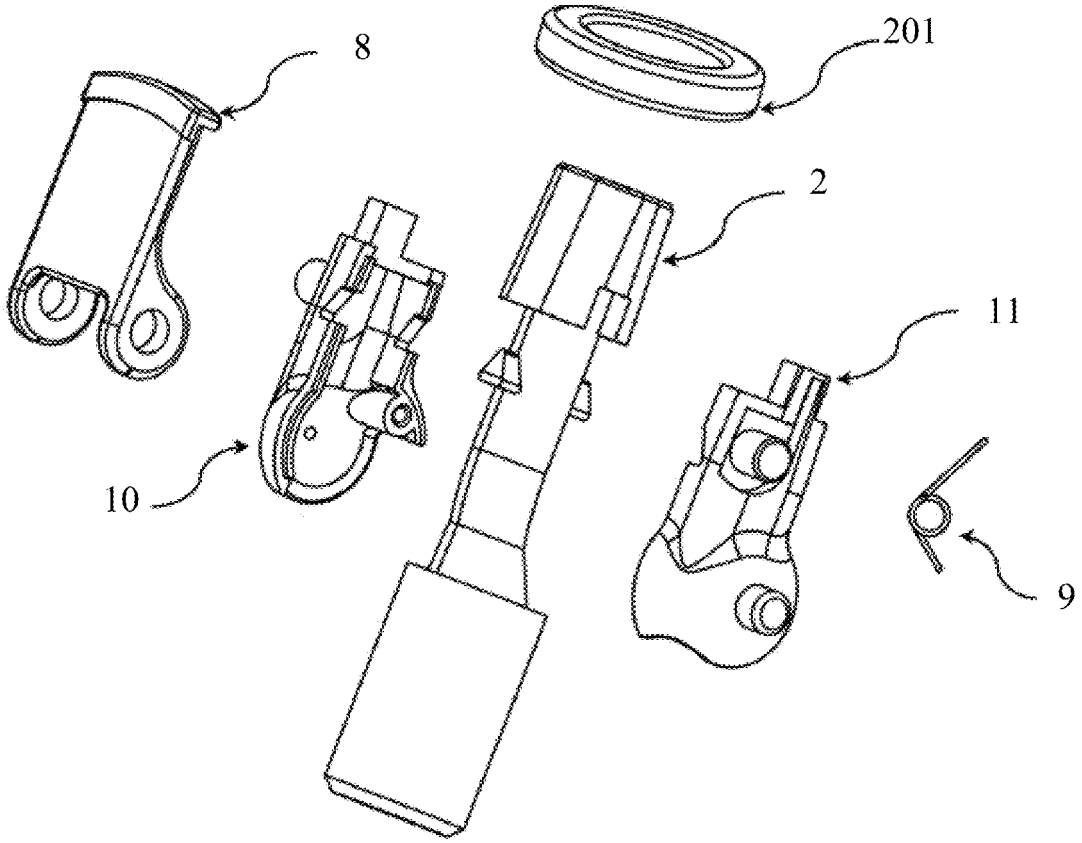
FIG. 5 is the exploded structure diagram of push button mechanism in preferred embodiment of dual-mode cup lid of the utility model.
Figure 6:
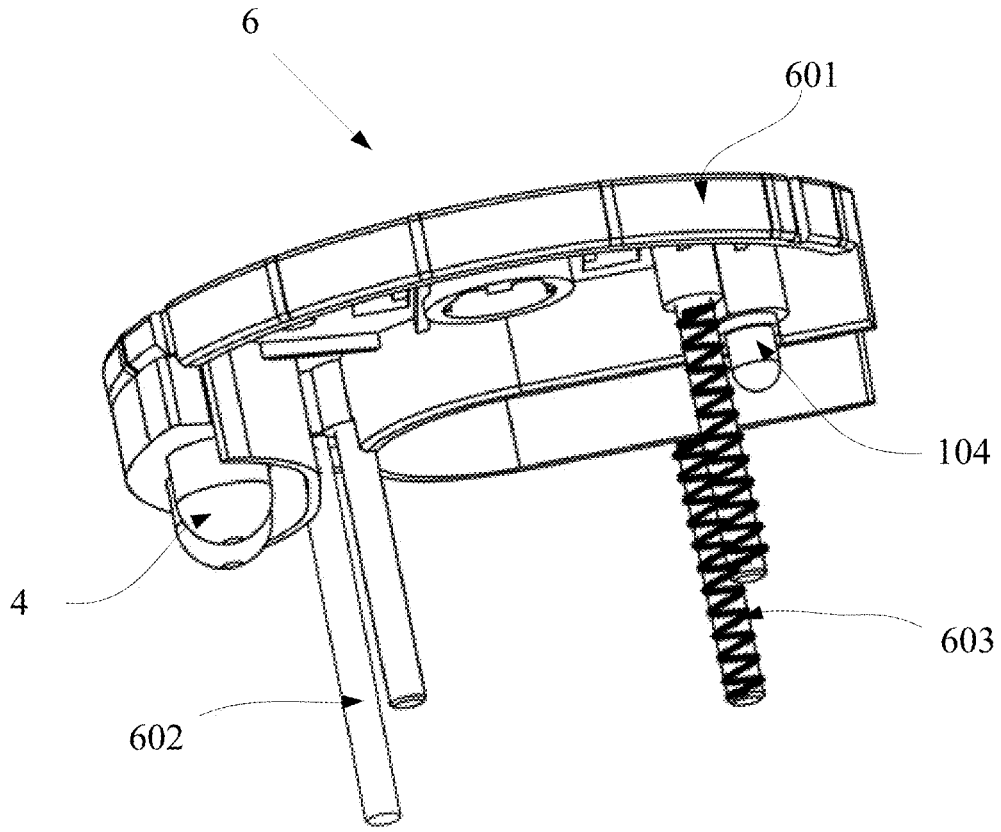
FIG. 6 is the overall structure diagram of horseshoe-shaped pressure seat in preferred embodiment of dual-mode cup lid of the utility model.
Figure 7:
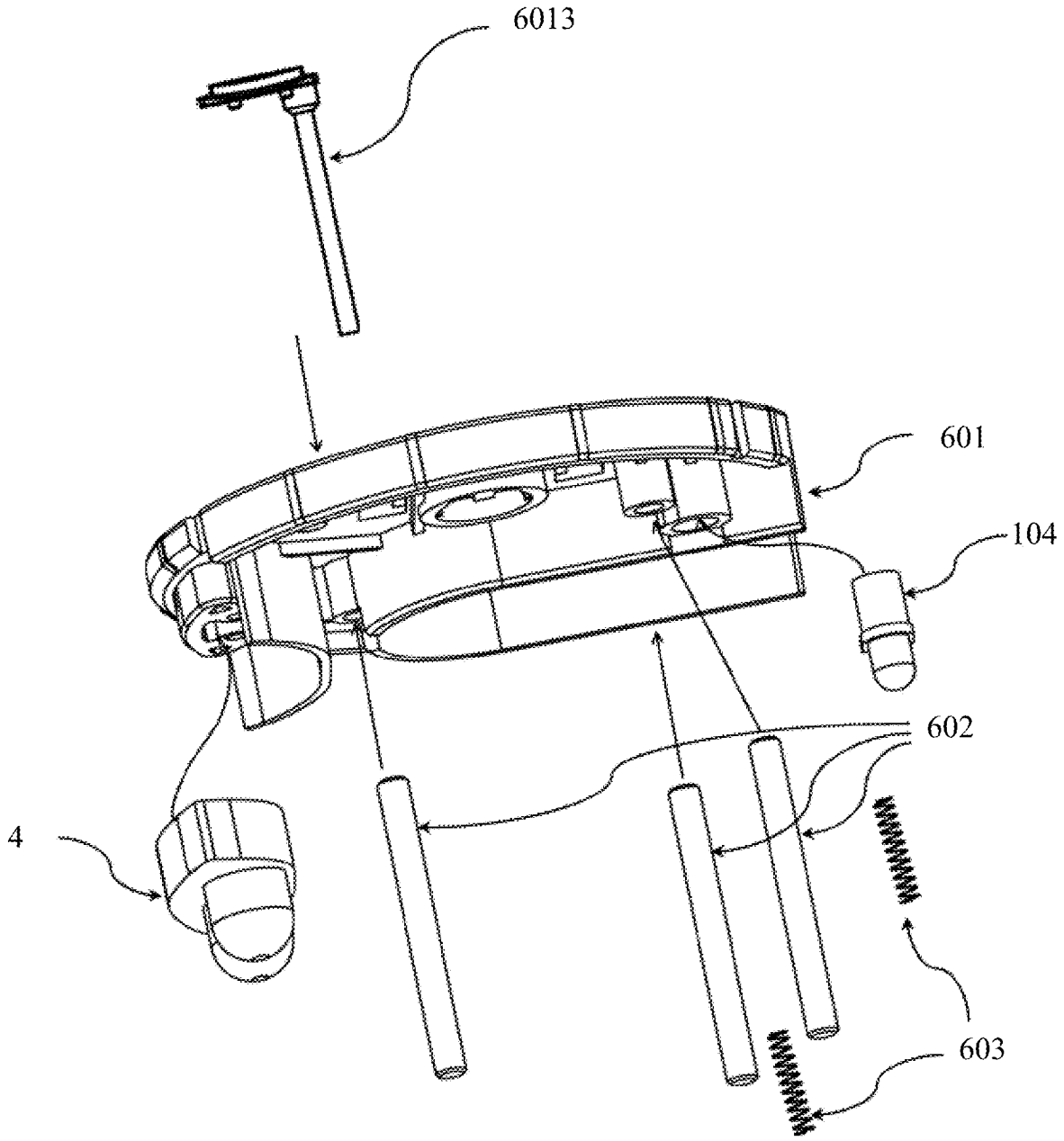
FIG. 7 is the exploded structure diagram of horseshoe-shaped pressure seat in preferred embodiment of dual-mode cup lid of the utility model.
Figure 8:
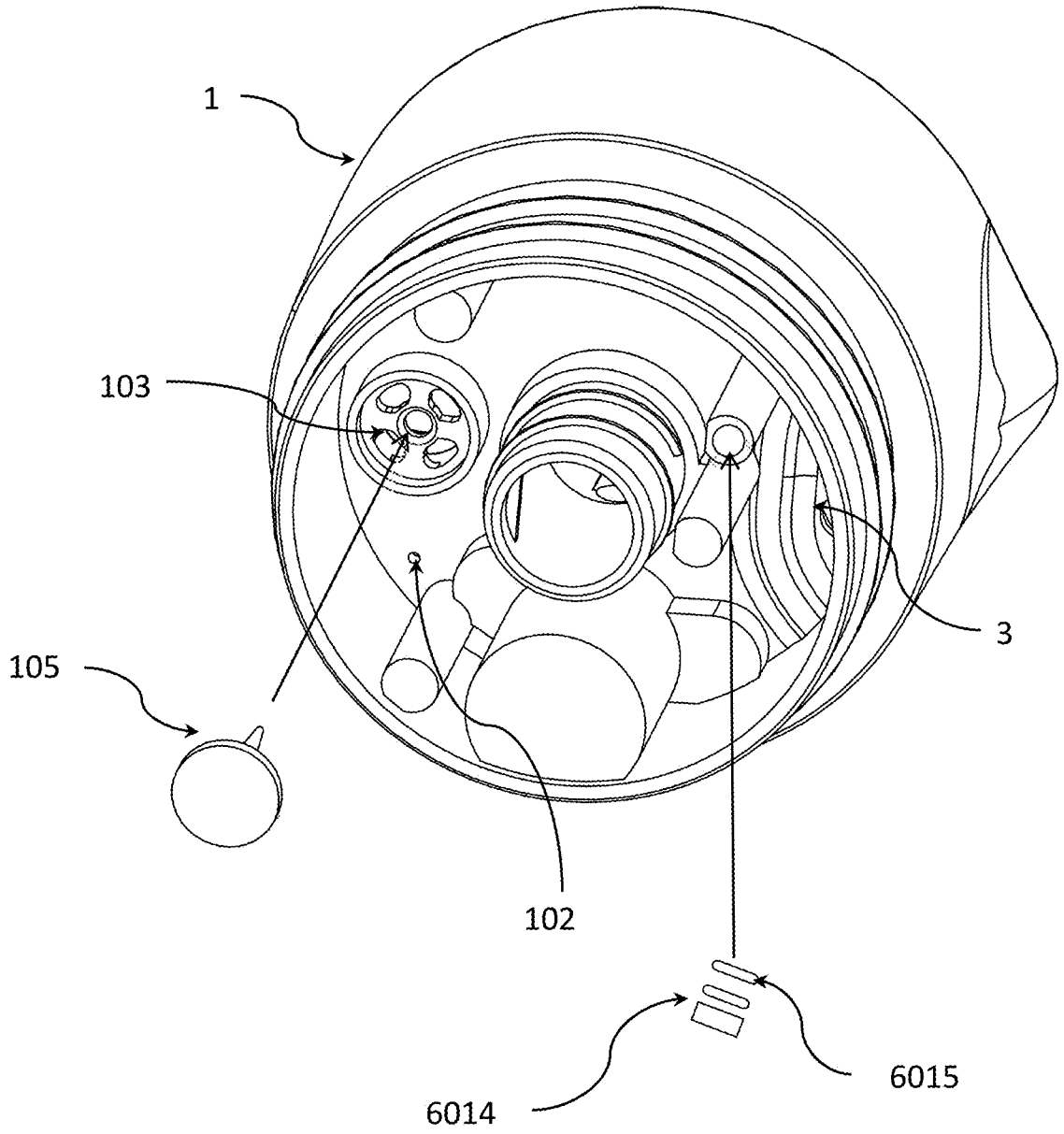
FIG. 8 is the bottom structure diagram of lid main body in preferred embodiment of dual-mode cup lid of the utility model.
Figure 9:
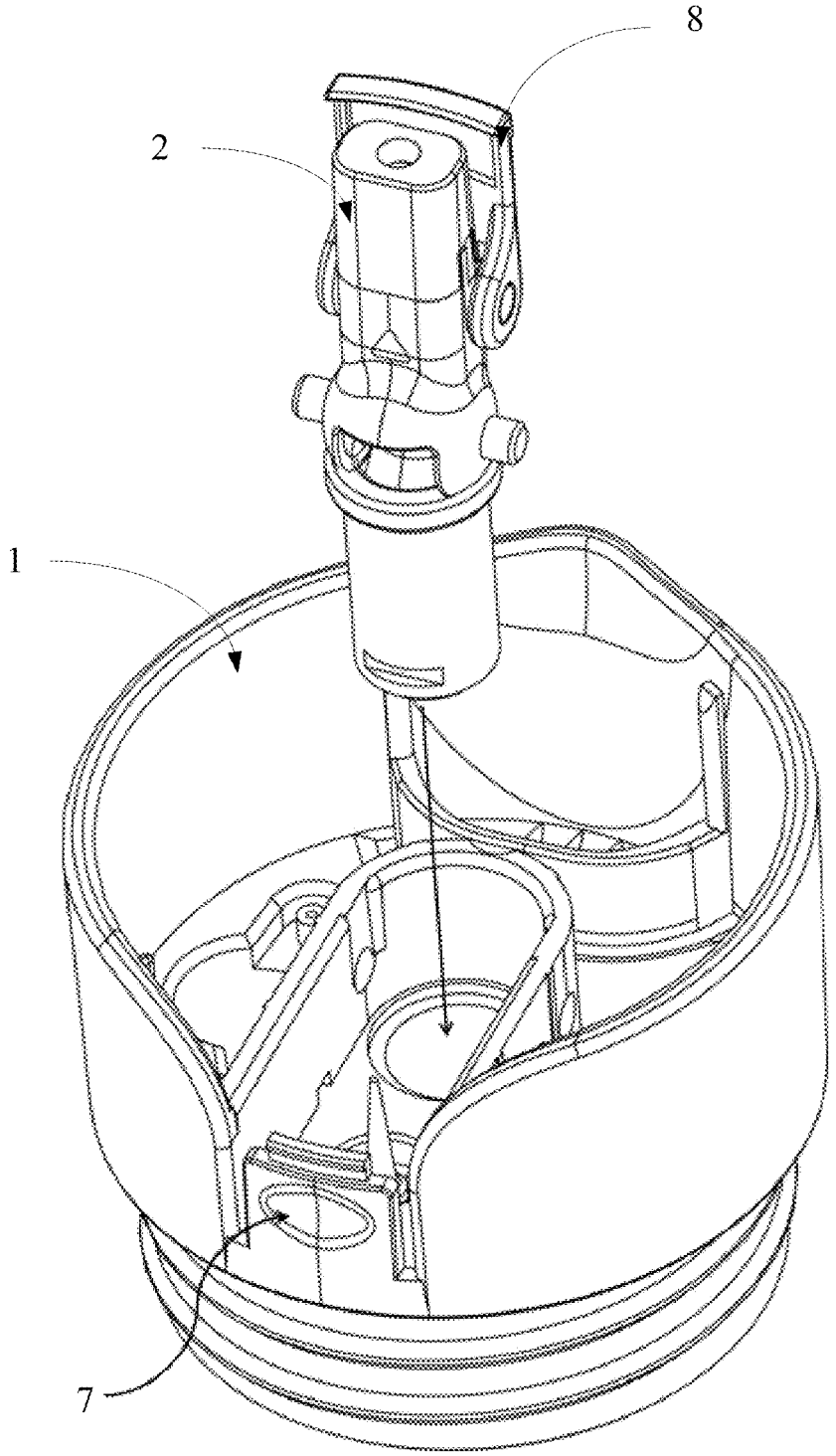
FIG. 9 is the assembly diagram of push button mechanism and lid main body in preferred embodiment of dual-mode cup lid of the utility model.
Figure 10:
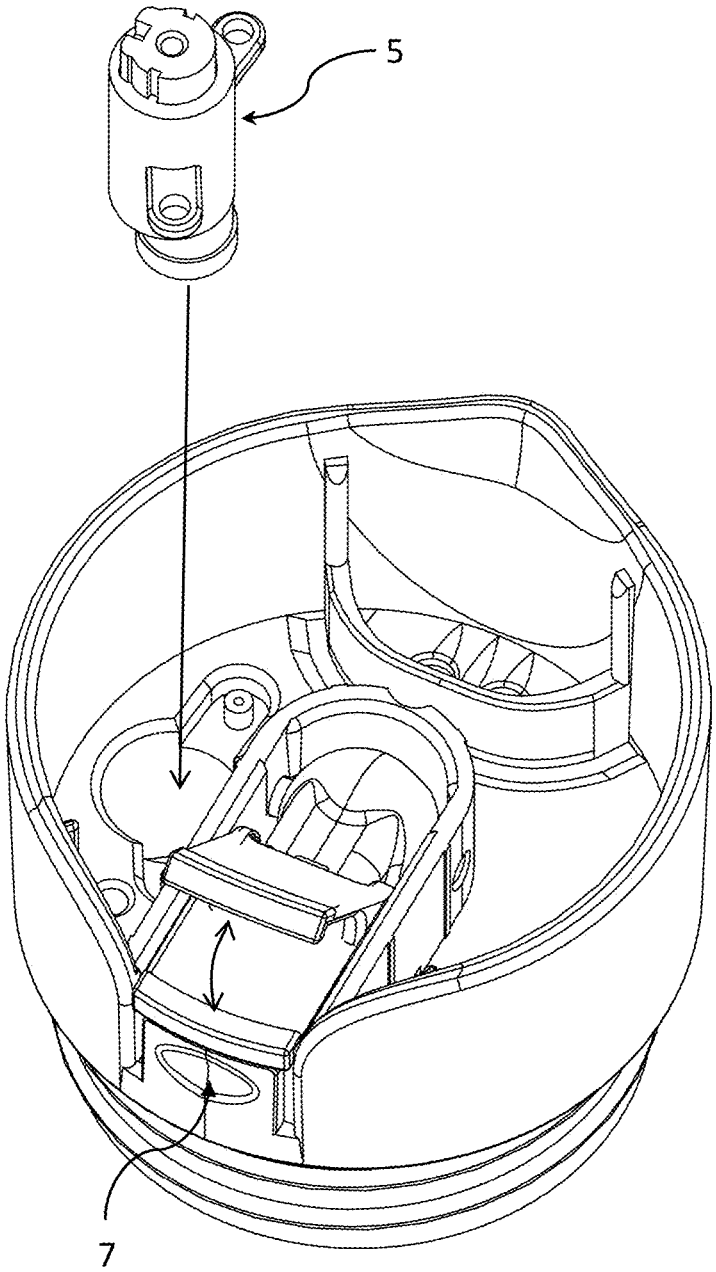
FIG. 10 is the assembly diagram of bounce buckle and lid main body in preferred embodiment of dual-mode cup lid of the utility model.
Figure 11:
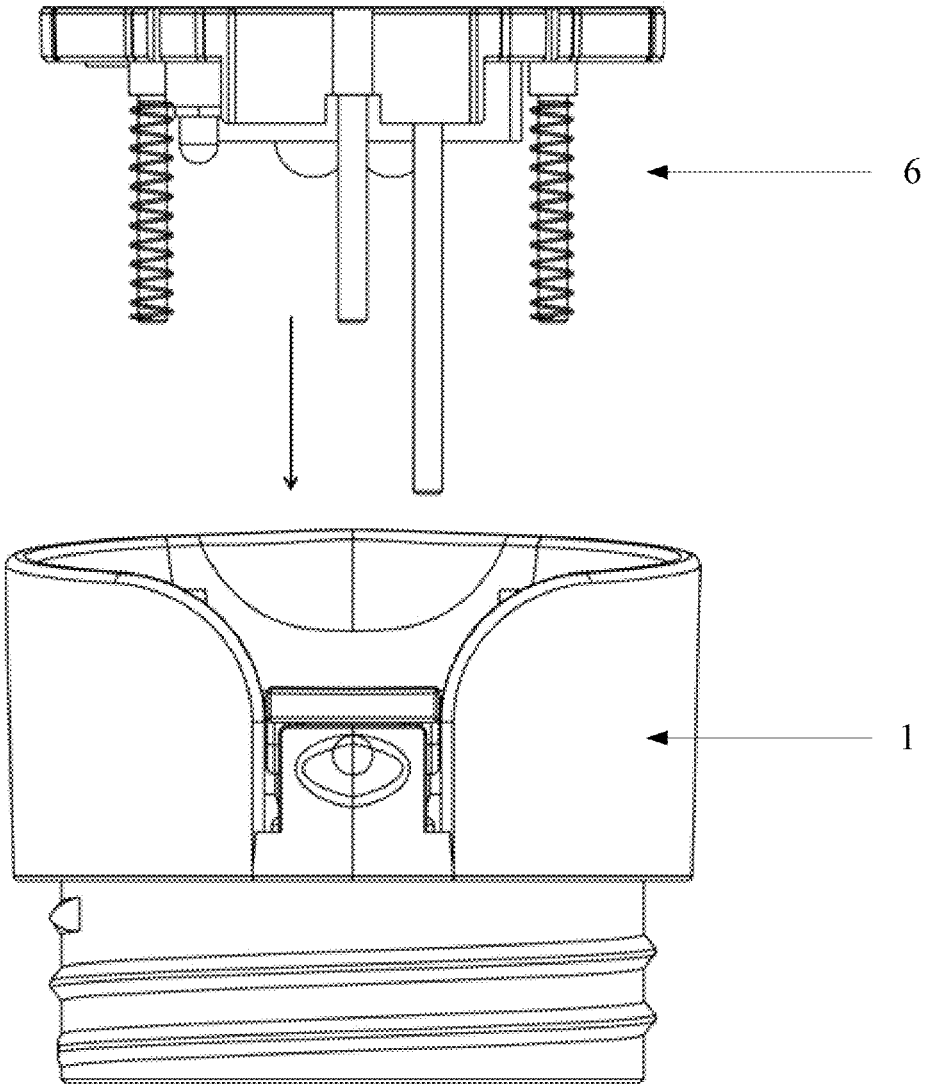
FIG. 11 is the assembly diagram of horseshoe-shaped pressure seat and lid main body in preferred embodiment of dual-mode cup lid of the utility model.
Figure 12:
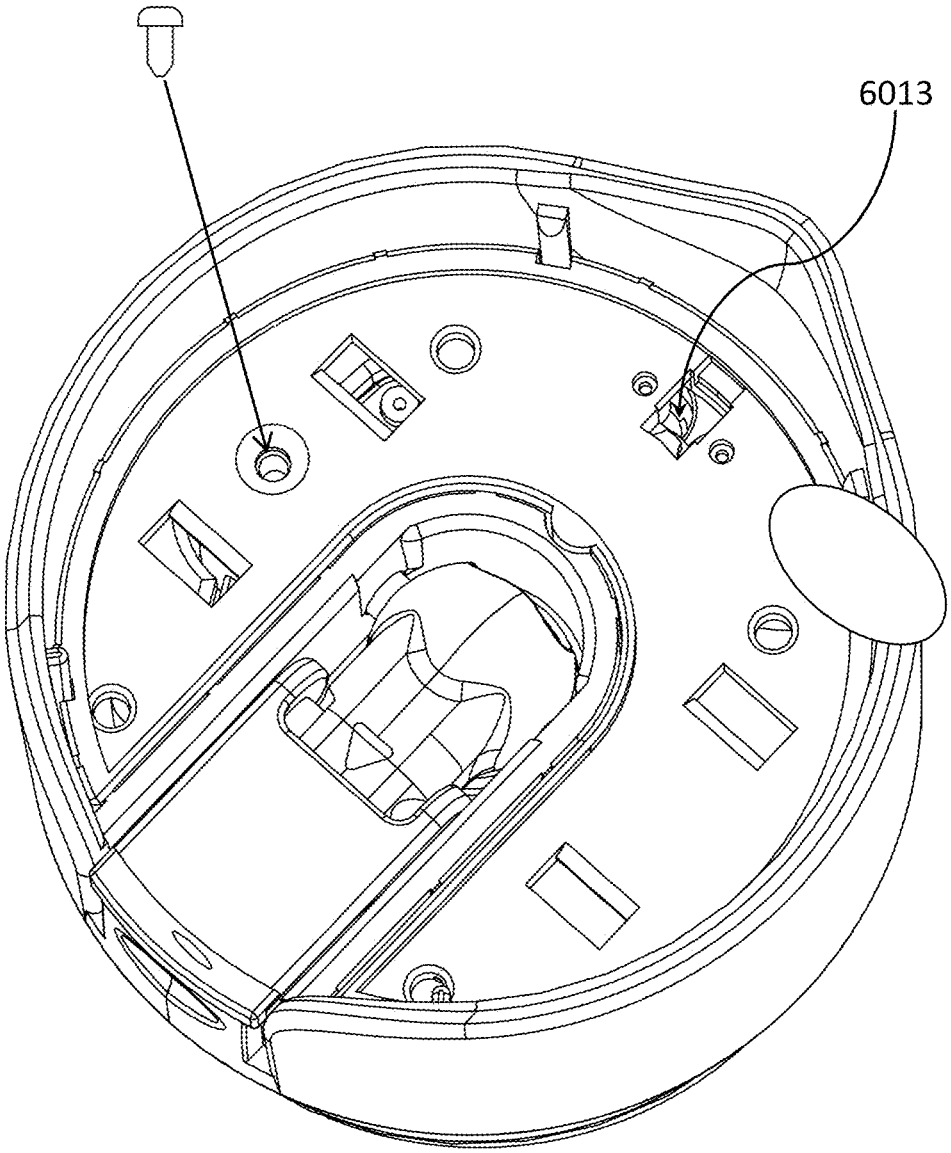
FIG. 12 is the top structure diagram of lid main body in preferred embodiment of dual-mode cup lid of the utility model.
Figure 13:
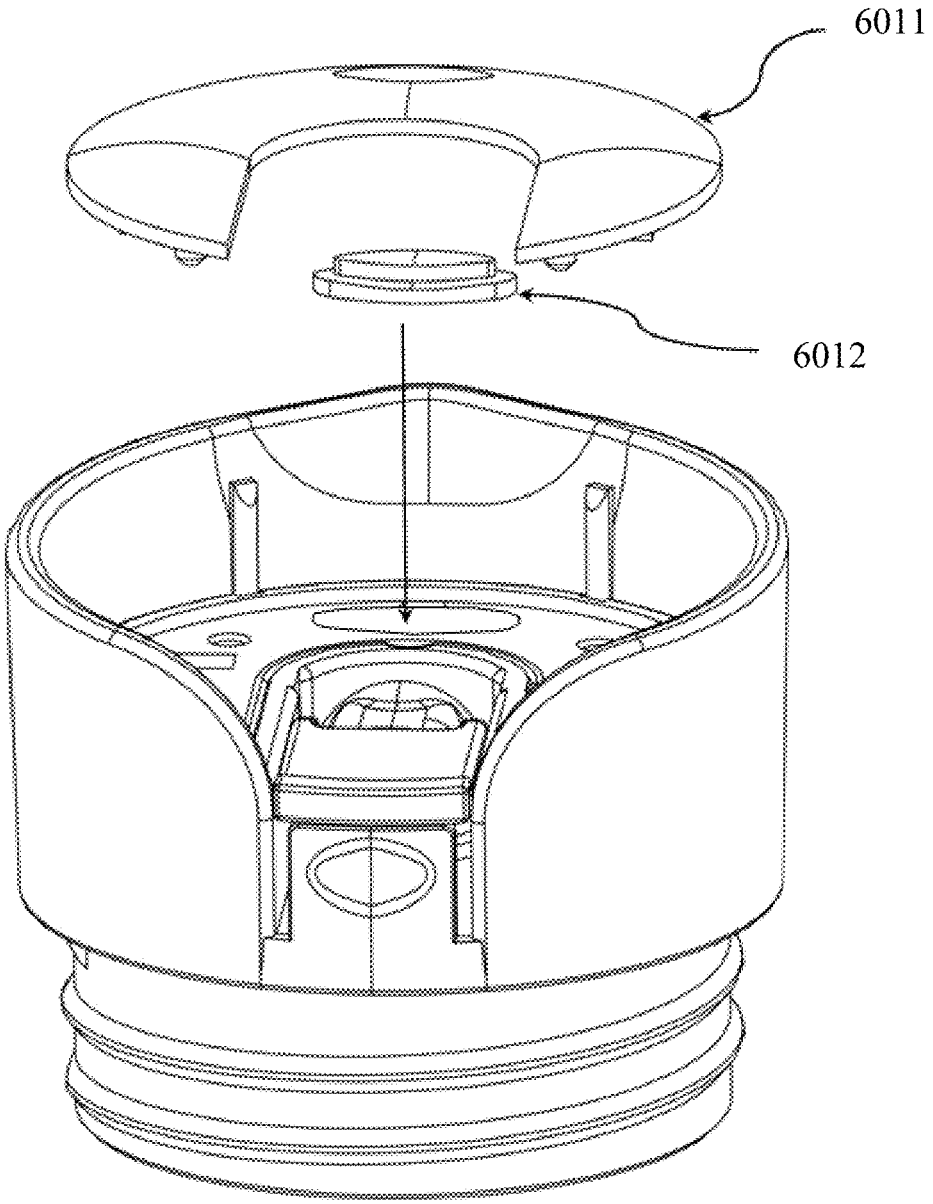
FIG. 13 is the assembly diagram of allochroic silicone, pressure plate and lid main body in preferred embodiment of dual-mode cup lid of the utility model.
Figure 14:
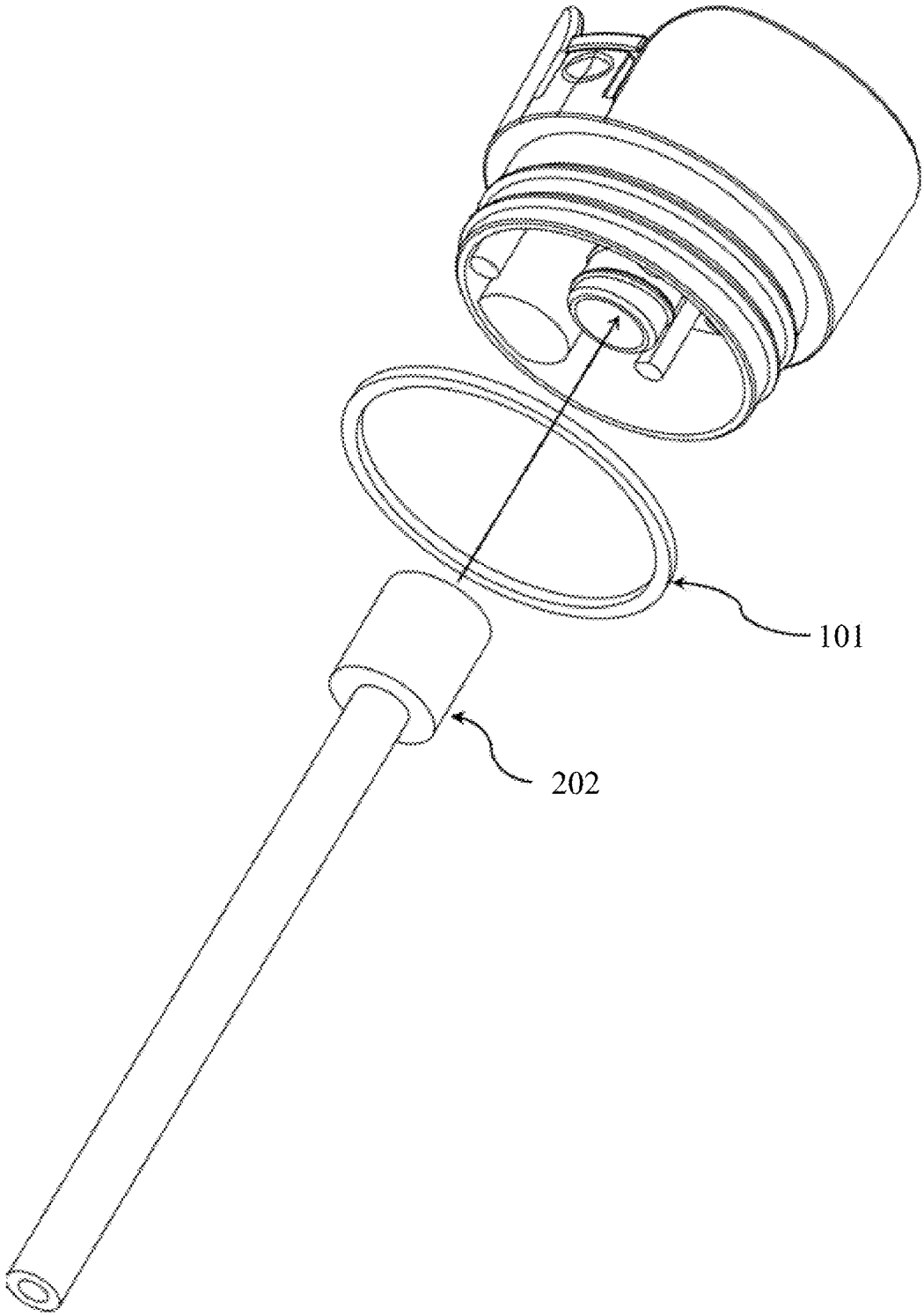
FIG. 14 is the assembly diagram of straw in preferred embodiment of dual-mode cup lid of the utility model.
Figure 15:
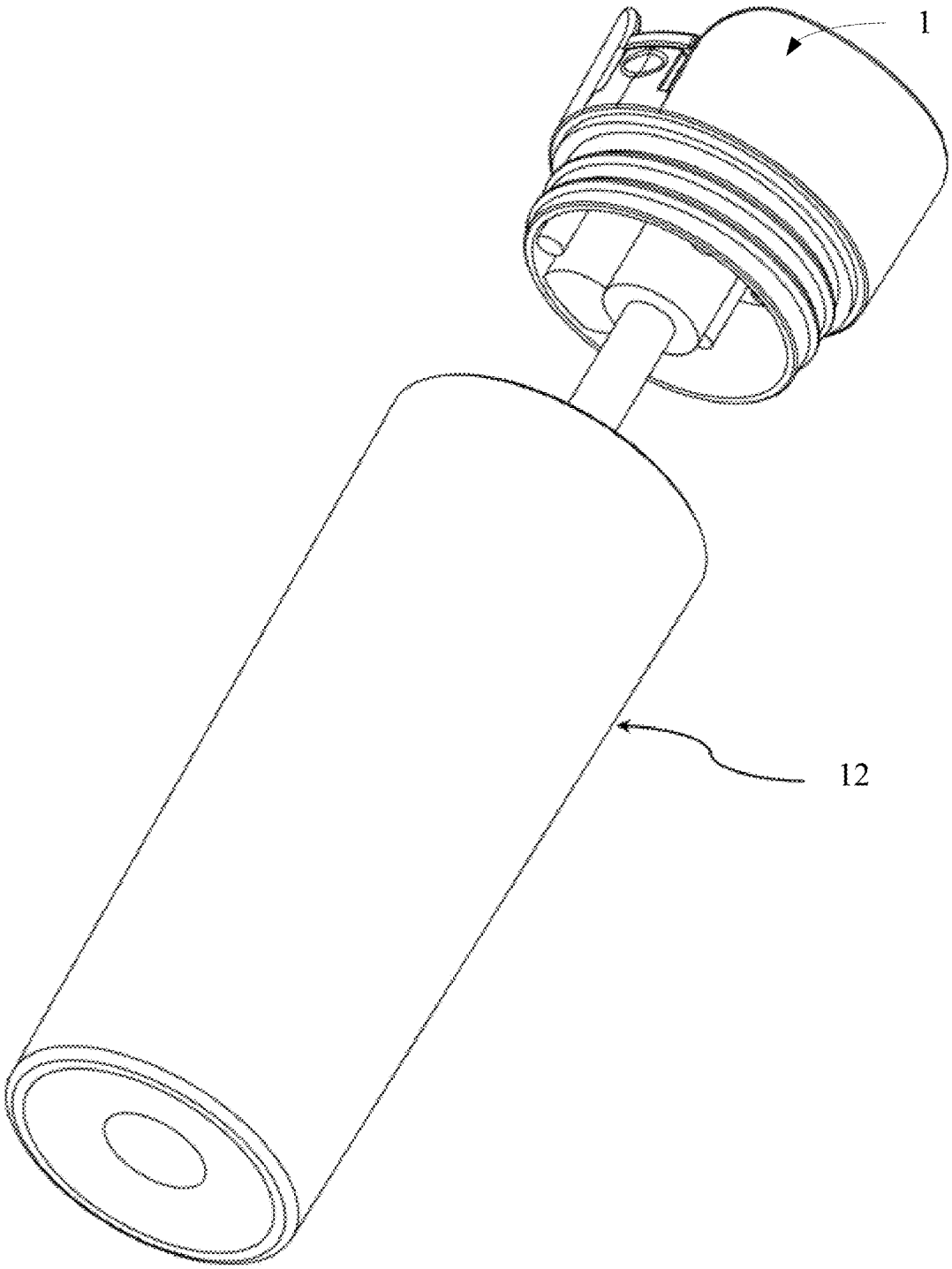
FIG. 15 is the assembly diagram of lid and cup in preferred embodiment of dual-mode cup lid of the utility model.

Please refer to FIGS. 1-15, the preferred embodiment of dual-mode cup lid of the utility model comprises a lid main body 1, a spout 2 is on said lid main body 1, a push button mechanism used for opening or closing said spout 2, a direct drinking mouth 3 is set on said lid main body 1, an elastic switching mechanism used for opening or closing said direct drinking mouth 3 also set on said lid main body 1.

It should be noted that, in the embodiment, said spout 2 is installed in the middle of said lid main body 1, said elastic switching mechanism is installed next to said spout 2. In specific implementation, there can be a space for placing said spout 2 in the middle position of said lid main body 1.

In the embodiment, a spout 2 and a direct drinking mouth 3 are installed on said lid main body 1, it is convenient for user drinking cold drinks through said spout 2 and drinking hot drinks through said direct drinking mouth 3, thus enrich the use method of cup lid, and meet diversified needs of users for drinking beverages with different temperatures.

In more details, said elastic switching mechanism comprises a bounce buckle 5, a horseshoe-shaped pressure seat 6 and a water outlet silicone 4 on said horseshoe-shaped pressure seat 6 provided opposite to said direct drinking mouth 5; said bounce buckle 5 is fixedly connected to said horseshoe-shaped pressure seat 6, when pushing said horseshoe-shaped pressure seat 6, said bounce buckle 5 will drive said horseshoe-shaped pressure seat 6 to move up and down through elasticity, thereby controlling the said water outlet silicone 4 to leave or seal the said direct drinking mouth 3, in order to realize opening or closing of said direct drinking mouth 3. Wherein, said bounce buckle 5 can be installed on said lid main body 1 by hot-press.

Further, said bounce buckle 5 comprises a buckle rod 501, a buckle shell 502, a hook 503 and a buckle ring 504, said buckle rod 501 is installed in said buckle shell 502, said buckle ring 504 is installed at the bottom of said buckle shell 502, sliding slot is set in said buckle rod 501, said sliding slot has open (bounce) position and close (fall) position, one end of said hook 503 is on the said open position or close position, another end of said hook 503 connects to said buckle ring 504, the upper end of said buckle shell connects to said horseshoe-shaped pressure seat 6.

When user uses said direct drinking mouth 3, only needs to push any part of said horseshoe-shaped pressure seat 6, in order to open said bounce buckle 5. When said bounce buckle 5 is opened, said horseshoe-shaped pressure seat 6 will rise up and make the said water outlet silicone 4 leave said direct drinking mouth 3, thus open the said direct drinking mouth 3.

When user closes said direct drinking mouth 3, only needs to push any part of said horseshoe-shaped pressure seat 6, in order to close said bounce buckle 5. When said bounce buckle 5 is closed, said horseshoe-shaped pressure seat 6 will drop down and make the said water outlet silicone 4 seal said direct drinking mouth 3.

When installing said bounce buckle 5, firstly install said buckle rod 501 to the proper position of said buckle shell 502, one end of said hook 503 and said buckle ring 504 are installed at the bottom of said buckle shell 502, then connect another end of said hook 503 to said buckle rod 501. When pushing said bounce buckle 5, through the elasticity of said buckle ring 504, said hook 503 will respectively hook in said open (bounce) position or close (fall) position according to the moving track of sliding slot in said buckle rod 501, then drive said horseshoe-shaped pressure seat to move up and down, thereby controlling the said water outlet silicone 4 to leave or seal the said direct drinking mouth 3, in order to realize opening or closing of said direct drinking mouth 3.

Said horseshoe-shaped pressure seat 6 comprises a horseshoe-shaped pressure seat entity 601, at least three guide shafts 602 installed on said horseshoe-shaped pressure seat entity 601, springs 603 are installed on said guide shafts 602, the lower ends of said springs 603 connect with lid main body 1, said water outlet silicone 4 is installed at the bottom of said horseshoe-shaped pressure seat entity 601, said horseshoe-shaped pressure seat entity 601 connects to said buckle shell 502. In specific implementation, said horseshoe-shaped pressure seat entity 601 can be connected with said buckle shell 502 by screw.

As a preferred implementation, three guide shafts 602 are used in the embodiment, wherein said three guide shafts 602 are arranged in a triangular position.

It should be noted that, in this embodiment, since said spout 2 needs to be placed in the middle position of said lid main body 1, so that said bounce buckle 5 cannot be placed in the middle position of said lid main body 1, then it will be placed beside said lid main body 1, when pushing said horseshoe-shaped pressure seat entity 601, different strengths are needed to switch said bounce buckle 5; in addition, the force is uneven when pushing said horseshoe-shaped pressure seat entity 601, so that said horseshoe-shaped pressure seat entity 601 cannot run smoothly. Therefore, said three guide shafts 602 are arranged in a triangular position in the embodiment, and the springs 603 are installed on said three guide shafts 602, so that when different positions of said horseshoe-shaped pressure seat entity 601 are pushed, it enables said bounce buckle 5 to switch, also ensures that said horseshoe-shaped pressure seat entity 601 can move up and down evenly.

Said push button mechanism comprises button 7, push part 8, torsional spring 9, the first cover 10 and the second cover 11; said button 7 is on said lid main body 1, said button 7 connects to clip of said push part 8, said first cover 10 and second cover 11 are respectively on two sides of said spout 2, said push part 8 is set on said first cover 10 and second cover 11 through said torsional spring 9. There is a pressure ring 201 setting on the middle-upper part of said spout 2.

When user needs to use said spout 2, only needs to push said button 7 by one hand, said push part 8 will drive said spout 2 to bounce under elasticity of said torsional spring 9.

When user pushes said push part 8 by one hand and it buckles said button 7, said spout 2 can be closed.

Said lid main body 1 is set on external cup 12, cup lid silicone 101 is set at the bottom of said lid main body 1, said horseshoe-shaped pressure seat entity 601 has pressure plate 6011, allochroic silicone 6012 and metal thermal conductor 6013 that connects to said allochroic silicone 6012, said allochroic silicone 6012 is set between said pressure plate 6011 and said horseshoe-shaped pressure seat entity 601, said metal thermal conductor 6013 extends to inside said cup 12, in order to transfer the temperature inside said cup 12 to said allochroic silicone 6012; said metal thermal conductor 6013 has sealing ring 6014 and sealing plug 6015.

In specific implementation, external thread line can be set at the lower end of said lid main body 1, internal thread line can be set in said lid main body 1, connect said lid main body 1 to said cup 12 with thread line.

Said metal thermal conductor 6013 can effectively transfer the temperature inside said cup 12 to the top end, and make the said allochroic silicone 6012 which connects to said metal thermal conductor 6013 change color, thus user can visually know the temperature of beverage in the cup 12, and use proper method to drink; for example, avoid having hot drinks through said spout 2 and burning the mouth.

Besides, in order to prevent the drinks spraying out from component connector of said metal thermal conductor 6013, sealing ring 6014 and sealing plug 6015 are set on said metal thermal conductor component for sealing treatment in the embodiment.

In the embodiment, a straw 202 is set at the lower end of said spout 2, said straw 202 extends to the bottom of said cup. There are a suck air inlet 103 and a direct drinking air inlet 102 on said lid main body 1, the suck sealing silicone 105 which matches to said suck air inlet 103 is set at the bottom of said lid main body 1, the direct drinking sealing silicone 104 which matches to said direct drinking air inlet 102 is set on said horseshoe-shaped pressure seat 6.

In the embodiment, said suck air inlet 103 and direct drinking air inlet 102 on said lid main body 1 can ensure the air pressures inside and outside said cup 12 are balanced when user uses spout 2 or direct drinking mouth 3, so that user can easily drink through said spout 2 or direct drinking mouth 3.

In conclusion, the utility model that dual-mode cup lid enriches the use method of cup lid, and meet diversified needs of users for drinking beverages with different temperatures through above technical schemes, wherein comprising a lid main body 1, a spout 2 is on said lid main body 1, a push button mechanism used for opening or closing said spout 2, a direct drinking mouth 3 is set on said lid main body 1, an elastic switching mechanism used for opening or closing said direct drinking mouth 3 also set on said lid main body 1.

Besides, in order to achieve above purpose, the utility model also provided a drinking cup, wherein comprising said dual-mode cup lid in above embodiment, the structure, function and principle of said dual-mode cup lid are described in above embodiment, and will not be repeated here.

The above are only the preferred embodiments, but cannot limit the scope of the utility model, any transformations of equivalent structure or equivalent process made by the specification and drawings of the utility model, or directly or indirectly used in other related technical fields, are also included in the patent protection scope of the utility model.

The invention claimed is:

1. A dual-mode cup lid, comprising:

a lid main body, a spout on said lid main body, a push button mechanism used for opening or closing said spout, a direct drinking mouth is set on said lid main body, and an elastic switching mechanism used for opening or closing said direct drinking mouth also set on said lid main body;

wherein said elastic switching mechanism comprises a bounce buckle, a horseshoe-shaped pressure seat and a water outlet silicone on said horseshoe-shaped pressure seat provided opposite to said direct drinking mouth; said bounce buckle is fixedly connected to said horseshoe-shaped pressure seat, when pushing said horseshoe-shaped pressure seat, said bounce buckle will drive said horseshoe-shaped pressure seat to move up and down through elasticity, thereby controlling the said water outlet silicone to leave or seal the said direct drinking mouth, in order to realize opening or closing of said direct drinking mouth;

wherein said bounce buckle comprises a buckle rod, a buckle shell, a hook and a buckle ring, said buckle rod is installed in said buckle shell, said buckle ring is installed at the bottom of said buckle shell, sliding slot is set in said buckle rod, said sliding slot has open position and closed position, one end of said hook is on the said open position or closed position, another end of said hook connects to said buckle ring, the upper end of said buckle shell connects to said horseshoe-shaped pressure seat.

2. The dual-mode cup lid of claim 1, wherein said horseshoe-shaped pressure seat comprises a horseshoe-shaped pressure seat entity, at least three guide shafts installed on said horseshoe-shaped pressure seat entity, springs are installed on said guide shafts, the lower ends of said springs connect with lid main body, said water outlet silicone is installed at the bottom of said horseshoe-shaped pressure seat entity, said horseshoe-shaped pressure seat entity connects to said buckle shell.

3. The dual-mode cup lid of claim 2, wherein said push button mechanism comprises button, push part, torsional spring, at first cover and a second cover; said button is on said lid main body, said button connects to clip of said push part, said first and second cover are respectively on two sides of said spout, said push part is set on said first and second cover through said torsional spring; when said button is pushed by external force, said push part will push said spout to bounce under elasticity of said torsional spring.

4. The dual-mode cup lid of claim 3, wherein there is a pressure ring setting on the middle-upper part of said spout.

5. The dual-mode cup lid of claim 4, wherein said lid main body is set on external cup, cup lid silicone is set at the bottom of said lid main body, said horseshoe-shaped pressure seat entity has pressure plate, allochroic silicone and metal thermal conductor that connects to said allochroic silicone, said allochroic silicone is set between said pressure plate and said horseshoe-shaped pressure seat entity, said metal thermal conductor extends to inside said cup, in order to transfer the temperature inside said cup to said allochroic silicone; said metal thermal conductor has a sealing ring and a sealing plug.

6. The dual-mode cup lid of claim 5, wherein a straw is set under said spout, said straw extends to the bottom of said cup.

7. The dual-mode cup lid of claim 6, wherein there are a suck air inlet and a direct drinking air inlet on said lid main body, the suck sealing silicone which matches to said suck air inlet is set at the bottom of said lid main body, the direct drinking sealing silicone which matches to said direct drinking air inlet is set on said horseshoe-shaped pressure seat.

8. A drinking cup, wherein comprising said dual-mode cup lid of claim 1.

* * * * *